US006929136B2

(12) United States Patent
Salazar-Leal

(10) Patent No.: US 6,929,136 B2
(45) Date of Patent: Aug. 16, 2005

(54) THERMOCHROMIC CAP

(75) Inventor: Rita Lorena Salazar-Leal, Monterrey (MX)

(73) Assignee: Fabricas Monterrey, S.A. de C.V., Monterrey (MX)

( * ) Notice: Subject to any disclaimer, the term of this patent is extended or adjusted under 35 U.S.C. 154(b) by 0 days.

(21) Appl. No.: 10/038,679

(22) Filed: Jan. 8, 2002

(65) Prior Publication Data

US 2003/0127416 A1 Jul. 10, 2003

(51) Int. Cl.[7] ..... B65D 41/04

(52) U.S. Cl. ..... 215/230; 116/216; 116/207; 374/162; 206/459.1

(58) Field of Search ..... 206/459.1; 215/230, 215/343; 116/216, 207; 436/1, 2, 164; 422/58, 61; 73/61.46, 61; 426/118, 231; 374/150, 151, 161, 162, 208, 159

(56) References Cited

U.S. PATENT DOCUMENTS 4,028,118 A * 6/1977 Nakasuji et al. ..... 106/31.19
4,111,322 A * 9/1978 Obrist et al. ..... 215/230
4,425,161 A 1/1984 Shibahashi et al.
4,717,710 A 1/1988 Shimizu et al.
4,805,188 A 2/1989 Parker
4,840,014 A * 6/1989 Takehana et al. ..... 53/432
4,905,851 A * 3/1990 Thompson ..... 215/203
4,933,525 A * 6/1990 St. Phillips ..... 219/725
4,957,949 A 9/1990 Kamada et al.
5,221,288 A 6/1993 Kamada et al.
5,415,312 A * 5/1995 Mueller ..... 220/254.3
5,431,697 A * 7/1995 Kamata et al. ..... 8/483
5,501,945 A 3/1996 Kanakkanatt
5,720,555 A 2/1998 Elele
5,769,255 A * 6/1998 Ohmi et al. ..... 215/345
5,786,578 A * 7/1998 Christy et al. ..... 219/720
5,839,581 A * 11/1998 Vagedes ..... 206/459.1
5,839,592 A * 11/1998 Hayes ..... 215/230
6,068,151 A 5/2000 Recendez M.
6,085,920 A 7/2000 Moretti
6,174,319 B1 1/2001 Desnos
6,264,033 B1 7/2001 Kannabiran et al.
6,318,584 B1 * 11/2001 Milan ..... 220/713
6,513,379 B2 * 2/2003 Meyers et al. ..... 73/426
6,579,006 B1 * 6/2003 Pariseau ..... 374/162
2002/0149003 A1 * 10/2002 Lucht et al. ..... 252/408.1
2002/0167989 A1 * 11/2002 Russo ..... 374/141
2003/0019954 A1 * 1/2003 Clarke ..... 239/333
2003/0080550 A1 * 5/2003 Phillips ..... 283/116

* cited by examiner

*Primary Examiner*—Lee Young
*Assistant Examiner*—James Smalley
(74) *Attorney, Agent, or Firm*—Oblon, Spivak, McClelland, Maier & Neustadt, P.C.

(57) ABSTRACT

The present invention provides a cap, which includes:

a cap body of a plastic composition; and at least one thermochromic material in contact with or admixed with the plastic composition, the thermochromic material selected such that the cap has a visually altered appearance when the cap temperature changes within a temperature range of −25 to 85° C.; wherein the cap is adapted to be removably secured to a beverage container, the container having an opening through which a beverage in the container can be dispensed from the container, and to cover the opening of the beverage container.

19 Claims, 1 Drawing Sheet

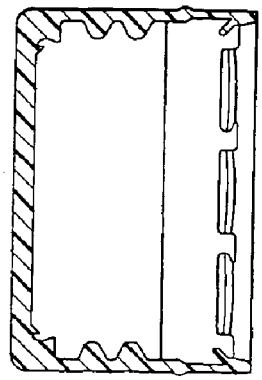
FIG. 1A
PRIOR ART
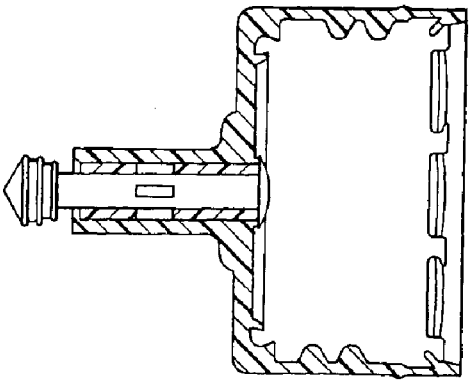
FIG. 1B
PRIOR ART
FIG. 2A
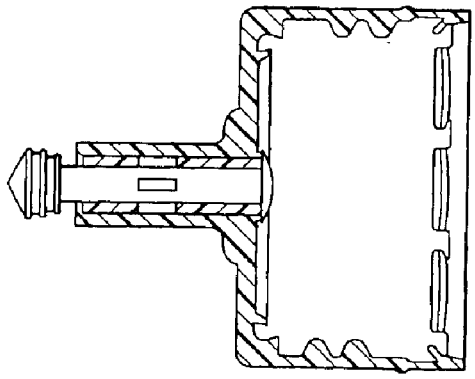
FIG. 2B
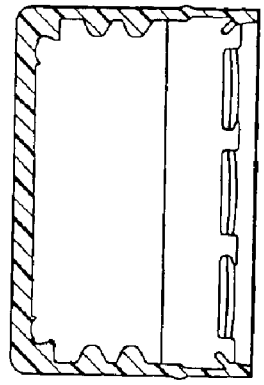
FIG. 2C

THERMOCHROMIC CAP

BACKGROUND OF THE INVENTION

1. Field of the Invention

The present invention relates to a plastic cap adapted to fit a beverage container, wherein the plastic cap can change color in response to temperature.

2. Discussion of the Background

Plastic caps are well known and are suitable for closing and sealing the contents of containers, such as for the use with carbonated and non-carbonated beverages, condiments, and other food products, as well as for use on non-food products, such as motor oil or pharmaceuticals (U.S. Pat. No. 6,085,920 to Moretti).

Various plastic closure constructions have been known for a number of years, and special design considerations have been made in order to increase the sealing properties, to facilitate the opening, and also when the bottlers have a promotional campaign and need a plastic cap that differentiates the product from the rest. For the beverage market, it is particularly desirable to have an attractive product that has a higher attractive value from the viewpoint of color.

Containers are known which incorporate thermochromic indicators in the lids. U.S. Pat. No. 6,174,319 describes a container for a hair-removal wax, and the thermochromic material effects a color change when the hair-removal wax reaches a sufficiently high temperature. U.S. Pat. No. 5,720,555 describes a temperature indicating container and lid apparatus, but the lid is not disclosed as removable.

SUMMARY OF THE INVENTION

One object of the present invention is to provide a container and cap having excellent presentation.

Another object of the present invention is to provide a container and cap having excellent expression creativity.

These and other objects have been achieved by the present invention, the first embodiment of which provides a cap, which includes:

a cap body of a plastic composition; and at least one thermochromic material in contact with or admixed with the plastic composition, the thermochromic material selected such that the cap has a visually altered appearance when the cap temperature changes within a temperature range of −25 to 85° C.;

wherein the cap is adapted to be removably secured to a beverage container, the container having an opening through which a beverage in the container can be dispensed from the container, and to cover the opening of the beverage container.

Another embodiment of the present invention includes a cap, which includes:

a cap body of a plastic composition;

a means for having a visually altered appearance when the cap temperature changes within a temperature range of −25 to 85° C.;

a means for removably securing the cap to a beverage container, the container having an opening through which a beverage in the container can be dispensed from the container; and a means for covering the opening.

Another embodiment of the present invention provides an article, which includes:

a beverage container having an opening through which a beverage in the container can be dispensed from the container; and a cap, which includes:

a means for removably securing the cap to the container, a means to cover the opening, and a means for having a visually altered appearance when the cap temperature changes within a temperature range of −25 to 85° C.

Another embodiment of the present invention provides a method for making the above-described articles, which includes contacting the cap with the container.

BRIEF DESCRIPTION OF THE FIGURES

A more complete appreciation of the invention and many of the attendant advantages thereof will be readily obtained as the same becomes better understood by reference to the following detailed description when considered in connection with the accompanying drawings, wherein:

FIGS. 1A and 1B are perspective views of a conventional one piece and multi-piece plastic cap.

FIGS. 2A through 2C are views of a one piece plastic cap in accordance with a first preferred embodiment of the invention.

BRIEF DESCRIPTION OF THE PREFERRED EMBODIMENTS

Various other objects, features and attendant advantages of the present invention will be more fully appreciated as the same becomes better understood from the following detailed description of the preferred embodiments of the invention.

Preferably, the cap according to the present invention changes its color in a temperature range from −25° C. to 85° C. The cap is suitable for use in both carbonated and non-carbonated beverage applications or for any container requiring a hermetic seal. For the beverage market, the cap has higher attractive value from the color-effect view point.

The present invention inheres many advantages over conventional designs for plastic closure caps. These include better presentation, visual temperature sensing and expression creativity.

According to the present invention there is provided a closure for a container that relates a means for expression creativity. The unique means are achieved in-part by the manufacture of a plastic cap.

Preferably, the plastic cap closure of the present invention includes a wall portion and a skirt portion, wherein the plastic cap has been treated with or contains a thermochromic material, which is capable of changing color in response to external and internal temperature conditions.

The cap may or may not include a liner or pilfer band (such as, for example, for returnable bottles) as appropriate, such liners and pilfer bands being known to those of skill in the art to which the invention pertains.

The thermochromic material will change color by the action of temperature in the range from −25° C. to 85° C. More preferably, the temperature at which color change is effected is −10 to 50° C., more particularly preferably 0 to 25° C., and most preferably 5 to 20° C. These ranges include all values and subranges therebetween, including −24, −20, −18, −14, −8, −5, −1, 1, 2, 4, 6, 8, 12, 15, 17, 20, 22, 24, 30, 35, 40, 55 and 75° C.

The color change may be reversible and irreversible. Preferably, the color change is reversible. The color change may include a first sequence during an increase of temperature, and a reverse sequence during temperature decrease. Preferably, the thermochromic material can change to any color.

Preferred thermochromic colors include Fast Yellow, Gold Orange, Vermillion, Brilliant Rose, Pink, Magenta, Fast Blue, Artic Blue, Brilliant Green, Fast Black, Green, Brown and the like. Mixtures of pigments and colors are possible.

The color change may be in response to internal temperatures of the contents of the container, to external temperatures, or both. The cap may or may not be in physical contact with the contents of the container. Preferably, the cap may be in thermal contact with the contents of the container.

The terms, thermochromic inks, dyes and pigments are used interchangably herein. Preferable thermochromic materials include thermochromic dyes, such as microencapsulated three-component mixtures of an acid developing substance, an acidic substance and a solvent.

Preferred examples of the acid developing substance include triphenylmethanephthalide compounds, phthalide compounds, phthalan compounds, Acyl Leucomethylene Blue compounds, fluoran compounds, triphenylmethane compounds, diphenylmethane compounds and spiropyran compounds. More preferred examples thereof include 3,3'-dimethoxyfluoran, 3,3'-dibutoxyfluoran, 3-chloro-6-phenylaminofluoran, 3-diethylamino-6-methyl-7-chlorofluoran, 3-diethyl-7,8-benzofluoran, 3,3',3"-tris(p-dimethylaminophenyl)phthlide, 3,3'-bis(p-dimethylaminophenyl)phthalide and 3-diethylamino-7-phenylaminofluoran. Mixtures are possible.

Preferred examples of the acidic substance include 1,2,3-benzotriazoles, phenols and oxy aromatic carboxylic acids. More preferable examples thereof include 5-chlorobenzotriazole, 5-butylbenzotriazole, bisbenzotriazole-5-methane, 5-oxybenzotriazole, phenol, nonylphenol, bisphenol A, bisphenol F, 2,2'-bisphenol, beta-naphthol 1,5-dihydroxynaphthalene, resorcinol, catechol, pyrogallol and phenol resin oligomers.

Preferred examples of the solvent include alcohols, alcohol-acrylonitrile adducts, azomethine and esters. More preferred examples thereof include decyl alcohol, lauryl alcohol, myristyl alcohol, cetyl alcohol, stearyl alcohol, behenyl alcohol, lauryl alcohol-acrylonitrile adducts, myristyl alcohol-acrylonitrile adducts, stearyl alcohol-acrylonitrile adducts, benzylidene-p-toluidine, benzylidene-butylamine, p-methoxybenzylideneaniline, and esters such as octyl caprylate, decyl caprylate, myristyl caprylate, decyl laurate, lauryl laurate, myristyl laurate, decyl myristate, lauryl myristate, cetyl myristate, lauryl palmitate, cetyl palmitate, stearyl palmitate, glycerol monostearate, glycerol monooleate cetyl p-t-butylbenzoate, stearyl 4-methoxybenzoate, dilauryl thiodipropionate dimyristyl thiodipropionate, benzyl thiodipropionbenzoate, distearyl thiodipropionate, benzyltrilaurate benzoate, pentaerythritol tetrastearate and pentaerythritol tetramyristate. Mixtures are possible.

As noted above, the thermochromic dye is preferably microencapsulated. The three-component mixture described above can be microencapsulated by, for example, the following method. A mixture containing at least each of the three components described above is first made molten with heating to yield an oily product. This oily product is added to water containing a surfactant, a protective colloid, a pH regulator, an electrolyte and other substances added as needed, followed by dispersion or emulsification while maintaining an agitation speed such that the grain size of the oil drops becomes 1 to 50 $\mu$m, preferably 2 to 20 $\mu$m. Then, a coat former is added and the oily product is microencapsulated by a known encapsulation method such as the interfacial polymerization method, the insight polymerization method or the coacervation method. The coat former described above may be added in any stage rather than immediately after the grain size adjustment described above or may be added in separate portions.

Preferred coat formers include polymer compounds such as polyurea, polyamide, polyester, polyurethane, epoxy resin, urea resin, melamine resin, gelatin, ethyl cellulose, polystyrene and polyvinyl acetate. Mixtures are possible.

Preferably, the surface of the microcapsule may be coated with a crosslinked initial condensation product of urea resin or melamine resin, epoxy resin, formaldehyde or an isocyanate compound thereby forming a double-coated fine particle.

Preferably, the coat for the microcapsule is a thermosetting resin because of its excellent heat resistance.

Other preferred thermochromic materials are described in U.S. Pat. No. 5,221,288 and U.S. Pat. No. 4,957,949, the entire contents of each of which are hereby incorporated by reference.

In addition to the thermochromic ink, the cap can be printed with conventional inks and/or can also contain other conventional pigments in admixture with the plastic composition in the cap body. Preferably, at a first temperature, one or more conventional colors are visible, and the thermochromic ink is either transparent or visible as a separate color. At a second temperature, the conventional printing or pigment may or may not remain visible, and the thermochromic ink is no longer transparent or is visible as a second color different from its first color. It is clear that many variants of this are possible. Another preferred embodiment includes a visible conventional printed layer and a transparent thermochromic layer at a first temperature and a visible thermochromic layer which completely or partially obscures the conventional printed layer at a second temperature, or vice-versa. Several thermochromic inks which change colors or which become transparent at different tempatures may also be included in a single cap.

The plastic cap material can include polypropylene, polyethylene, polyethylene terephthalate, homopolymers thereof, copolymers thereof, and mixtures thereof.

The thermochromic material may be blended or formulated with, or coated onto the plastic cap composition according to known methods.

The thermochromic ink may be incorporated into the cap by any method for producing a plastic product. Preferable methods include one or more of injection moulding, extrusion, and compression moulding. Preferably, the pigment can be incorporated as a master batch directly in the extruder, or mixed manually (if pelleted, for example) with the cap material in advance.

The amount of thermochromic material contained in the cap is not particularly limited so long as the desired thermochromic effect is achieved. Preferably, the thermochromic material is present in the cap in an amount of 1–50% by weight, based on the weight of the cap. More preferably, the thermochromic material is present in an amount of 2–40% by weight, more particularly preferably, 10–20% by weight. These ranges include all values and subranges therebetween, including 5, 8, 9, 15, 25, 35, 39, 45 and 49% by weight, based on the weight of the cap.

In addition to the thermochromic material, the cap material may optionally include one or more conventional additives, such as ultraviolet absorber, antioxidant, dye, pigment, optical brightener, metal soap, surfactant, water repellent, filler, nucleation agents, antistatic agents, foaming agents, slip agents, and combinations thereof.

Preferably, the cap can be molded by compression or injection.

The cap can be in one or more pieces. When more than one piece is used for the cap, the thermochromic material can be incorporated into one piece, more than one piece, or every piece. Other preferred caps are described in U.S. Pat. No. 6,068,151 and U.S. Pat. No. 6,126,025, the entire contents of each of which being hereby incorporated by reference.

Referring now to the figures, in FIGS. 1A and 1B there are shown two plastic caps, which are suitable for the present invention. These caps can be molded by compression or injection.

As noted above, the cap can be in one or more pieces, and FIGS. 2A through 2C show some of the various preferred embodiments of the present invention.

The container material is not particularly limited, and may include any thermoplastic or thermosetting polymer resin known to those in the container arts. Preferable container compositions include polyethylene, polystyrene, and the like.

The container may be molded in accordance with known methods. These include blow molding, vacuum molding, thermoforming, and the like.

Other preferred embodiments include a method for making the article according to the invention.

Having now fully described this invention, it will be apparent to one of ordinary skill in the art that many changes and modifications can be made thereto without departing from the spirit or scope of the invention as set forth herein.

What is claimed is:

1. An article, comprising:

a beverage container having an opening through which a beverage in the container can be dispensed from the container; and a threaded cap adapted to be removably secured to said container to cover said opening, wherein a material comprising said cap comprises at least one thermochromic material in admixture with at least one thermoplastic polymer resin, said thermochromic material selected such that the cap has a visually altered appearance when the cap temperature changes within a temperature range of −25 to 85° C., wherein said cap further comprises at least one non-thermochromic printing ink layer on at least a portion of an outer surface thereof, and said non-thermochromic printing ink is visible at a first temperature of said cap and is not visible at a second temperature of said cap.

2. The article of claim 1, wherein the visible non-thermochromic printing ink has a different color than a color of the cap.

3. The article of claim 1, wherein at said first temperature, one or more conventional cap colors are visible and a thermochromic ink is either transparent or visible as a first color, and, at said second temperature, said thermochromic printing ink is no longer transparent or is visible as a second color different from its first color.

4. The article of claim 1, wherein a thermochromic ink is transparent at said first temperature and is visible at said second temperature.

5. The article as claimed in claim 1, wherein said temperature range is −10 to 40° C.

6. The article as claimed in claim 1, wherein said temperature range is 0 to 25° C.

7. The article as claimed in claim 1, wherein said temperature range is 5 to 20° C.

8. The article as claimed in claim 1, wherein said material comprising said cap further comprises at least one thermoplastic polymer resin is selected from the group consisting of polypropylene, polyethylene, copolymers of polypropylene and polyethylene, and combinations thereof.

9. The article as claimed in claim 8, wherein said polyethylene is selected from the group consisting of linear, high density, low density polyethylene, and combinations thereof.

10. The article as claimed in claim 1, wherein said visibly altered appearance comprises a change in a color of said cap.

11. The article as claimed in claim 1, wherein said cap is a one-piece cap.

12. The article as claimed in claim 1, wherein said cap comprises more than one piece.

13. The article as claimed in claim 1, further comprising a beverage, and wherein said beverage is carbonated or non-carbonated.

14. The article as claimed in claim 1, wherein said cap provides a hermetic seal on said container.

15. The article as claimed in claim 1, wherein the admixed thermochromic material is present in the cap in an amount of 1–50% by weight, based on the weight of the cap.

16. The article as claimed in claim 1, wherein the thermoplastic polymer resin of the cap further comprises at least one selected from the group consisting of ultraviolet absorber, antioxidant, dye, pigment, optical brightener, metal soap, surfactant, water repellant, filler, nucleation agent, antistatic agent, foaming agent, slip agent, and combinations thereof.

17. The article as claimed in claim 1, wherein, the threaded cap further comprises a liner.

18. A method for making the article as claimed in claim 1, comprising contacting said cap with said container.

19. The method as claimed in claim 18, further comprising, prior to said contacting, filling said container with said beverage.

* * * * *